US009329572B2

(12) United States Patent
Helfer et al.

(10) Patent No.: US 9,329,572 B2
(45) Date of Patent: May 3, 2016

(54) TIMEPIECE HAND

(75) Inventors: Jean-Luc Helfer, Bienne (CH); Yves Winkler, Schmitten (CH)

(73) Assignee: The Swatch Group Research and Development Ltd., Marin (CH)

( * ) Notice: Subject to any disclaimer, the term of this patent is extended or adjusted under 35 U.S.C. 154(b) by 115 days.

(21) Appl. No.: 13/806,368

(22) PCT Filed: Jun. 21, 2011

(86) PCT No.: PCT/EP2011/060282

§ 371 (c)(1),
(2), (4) Date: Mar. 14, 2013

(87) PCT Pub. No.: WO2011/161077

PCT Pub. Date: Dec. 29, 2011

(65) Prior Publication Data

US 2013/0163391 A1 Jun. 27, 2013

(30) Foreign Application Priority Data

Jun. 22, 2010 (EP) ..... 10166844

(51) Int. Cl.

| | |
|---|---|
| ***G04B 19/04*** | (2006.01) |
| ***B22D 17/00*** | (2006.01) |
| ***B22D 25/02*** | (2006.01) |
| ***C22C 45/10*** | (2006.01) |
| ***G04D 3/00*** | (2006.01) |

(52) U.S. Cl.

CPC ..... *G04B 19/042* (2013.01); *B22D 17/007* (2013.01); *B22D 25/026* (2013.01); *C22C 45/10* (2013.01); *G04B 19/04* (2013.01); *G04D 3/0046* (2013.01)

(58) Field of Classification Search

CPC .... G04B 13/026; G04B 19/04; G04B 19/042; B22C 9/20; B22D 17/00; B22D 19/04; B22D 25/02; B22D 17/007; B22D 25/026; C22C 45/10; G04D 3/0046

USPC ..... 368/80, 102, 228, 238

See application file for complete search history.

(56) References Cited

U.S. PATENT DOCUMENTS

| | | | | |
|---|---|---|---|---|
| 4,967,402 | A * | 10/1990 | Claude | 368/280 |
| 6,306,228 | B1 * | 10/2001 | Inoue et al. | 148/538 |
| 2001/0013402 | A1 | 8/2001 | Sakamoto et al. | |
| 2004/0004909 | A1 * | 1/2004 | Fujimori | 368/204 |
| 2004/0105347 | A1 * | 6/2004 | Fujimori et al. | 368/293 |
| 2007/0034304 | A1 * | 2/2007 | Inoue et al. | 148/561 |

(Continued)

FOREIGN PATENT DOCUMENTS

| | | |
|---|---|---|
| EP | 0 489 503 | 6/1992 |
| EP | 0 904 875 | 3/1999 |

(Continued)

OTHER PUBLICATIONS

International Search Report Issued Sep. 29, 2011 in PCT/EP11/60282 Filed Jun. 21, 2011.

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A timepiece hand for abrupt acceleration is mounted to pivot around a staff so as to be able to indicate an item of information. The hand is made from an at least partially amorphous metal alloy.

7 Claims, 5 Drawing Sheets

(56) References Cited

U.S. PATENT DOCUMENTS

| | | | | |
|---|---|---|---|---|
| 2010/0254227 | A1* | 10/2010 | Kamiya | 368/101 |
| 2011/0056301 | A1* | 3/2011 | Winkler et al. | 73/714 |
| 2011/0205854 | A1* | 8/2011 | Wiederrecht | 368/132 |
| 2012/0140603 | A1* | 6/2012 | Sarchi et al. | 368/272 |
| 2012/0222785 | A1* | 9/2012 | Li et al. | 148/561 |
| 2012/0243389 | A1* | 9/2012 | Sciascia et al. | 368/315 |

FOREIGN PATENT DOCUMENTS

| | | |
|---|---|---|
| JP | 55 145138 | 11/1980 |
| JP | 55 145139 | 11/1980 |
| JP | 56 66780 | 6/1981 |
| JP | 57 108686 | 7/1982 |
| JP | 2001 124869 | 5/2001 |

* cited by examiner

TIMEPIECE HAND

CROSS-REFERENCE TO RELATED APPLICATIONS

This is a National Phase Application in the United States of International Patent Application PCT/EP2011/060282 filed Jun. 21, 2011, which claims priority on European Patent Application No. 10166844.0 of Jun. 22, 2010. The entire disclosures of the above patent applications are hereby incorporated by reference.

The present invention relates to a timepiece hand, wherein said hand is mounted to pivot around an axis so as to indicate a piece of information.

The technical field of the invention is the technical field of fine mechanics.

TECHNOLOGICAL BACKGROUND

It is known that timepieces have hands. These hands consist of a bar with a length that is much larger than the width, which is itself much larger than the thickness. These hands comprise an opening for them to be pressed onto a staff in order to be mounted to pivot. In order to have hands that are fine and strong, it is provided to form them from a crystalline metal such as steel, brass, gold or even silicon or ceramic. These hands can be machined or cut out of a sheet by laser or water jet. They can also be moulded, sintered or formed by growing or depositing material. These hands are then used, for example, to indicate the hours, minutes and seconds, but are also used to perform certain functions such as chronograph functions or calendar functions.

These hands are in fact subjected to numerous stresses. One of these stresses is the weight of the hand itself. In fact, the hand is generally pressed onto its staff at one of its ends. Considering the small dimensions of a hand, it is completely normal for it to bend, if only slightly, under its own weight as a result of this. This weight stress is also applied to the unbalance that serves as counterweight for the hand.

The hand is also subjected to acceleration stresses. These stresses can be due firstly to the displacement controlled by the timepiece movement. This displacement is linked to the time display or to a function of said timepiece such as the chronograph function and can be retrograde. A return to zero of the hands occurs in the case of a retrograde display or during use of the chronograph function. This return to zero consists of an abrupt return of the hand to its initial position. During this return to zero operation the acceleration of the hand can reach $1.10^6$ rad·s$^{-2}$. Such an acceleration involves a high stress applied to the hand during acceleration and also during deceleration and stoppage of the hand.

Secondly, the stresses linked to acceleration can be due to a shock applied to the watch. In fact, when the watch falls, for example, it is subjected to acceleration. The energy accumulated during this fall is transferred to the hands upon contact of said watch with the ground. These shocks can then deform the hand or the unbalance, which can then cause problems during displacement of the hand.

A disadvantage of hands made from crystalline metal is their low mechanical resistance when high stresses are applied. In fact, each material is characterised by its Young's modulus E also referred to as modulus of elasticity (generally expressed in GPa), which characterises its resistance to deformation. Each material is also characterised by its elastic limit $\sigma_e$ (generally expressed in GPa) that represents the stress beyond which the material is plastically deformed. It is thus possible, with given dimensions, to compare the materials by establishing for each the ratio of their elastic limit to their Young's modulus $\sigma_e/E$ said ratio being representative of the elastic deformation of each material. Thus, the higher this ratio is, the higher the elastic deformation of the material. Typically, for an alloy such as Cu—Be the Young's modulus E is equal to 130 GPa and the elastic limit $\sigma_e$ is equal to 1 GPa, which gives a $\sigma_e/E$ ratio in the order of 0.007, i.e. a low ratio. Hands made of crystalline metal or alloy consequently have a limited elastic deformation. Consequently, during a return to zero or a shock the stresses applied to said hands can be so high that the hands deform plastically, i.e. they twist. This deformation thus poses a problem of readability and reliability of the information.

This deformation phenomenon is even more accentuated in the case of crystalline precious metals. In fact, these have even poorer mechanical characteristics. Precious metals have in particular a low elastic limit in the order of 0.5 GPa for alloys of Au, Pt, Pd and Ag compared to about 1 GPa for crystalline alloys classically used in the production of hands. Given that the elasticity modulus of these precious metals is in the order of 120 GPa, there results a $\sigma_e/E$ ratio of about 0.004, that is to say an even lower figure than for non-precious alloys. The risks of deformation as a result of stresses applied during a significant acceleration such as a return to zero are thus increased. Consequently, a person skilled in the art is not encouraged to use these precious metals for the production of a timepiece hand. However, these precious metals are in high demand since they have a significant extra aesthetic value and exude a sense of superior quality.

In addition, current methods such as stamping, laser cutting or growth by deposition are limited. They do not allow three-dimensional hands to be formed. In fact, in the case of stamping or laser cutting the hands are formed from a sheet. The disadvantage in the case of the production of hands by LIGA type material growth is that the walls of the hands are straight and that no angled type of inclination is therefore possible.

SUMMARY OF THE INVENTION

The aim of the invention is to overcome the disadvantages of the prior art by proposing to provide a metal hand for abrupt acceleration that does not deform during its displacement in order to have precise readability and significant durability.

On this basis, the invention relates to the aforementioned hand, which is characterised in that it is made from a completely amorphous metal alloy comprising at least one metallic element chosen from the group formed by gold, platinum, palladium, rhenium, ruthenium, rhodium, silver, iridium or osmium.

A first advantage of the present invention is to enable the formation of hands made from precious metal that can withstand shocks or abrupt accelerations. It thus becomes possible to form hands made from precious materials with similar dimensions to those made from non-precious materials or crystalline precious materials without any risk of them deforming during significant acceleration. In fact, surprisingly, amorphous precious metals have more interesting elastic characteristics than their crystalline equivalents. The elastic limit $\sigma_e$ is increased allowing the $\sigma_e/E$ ratio to be increased such that the stress beyond which the material does not return to its initial shape is increased for the material.

Another advantage of the present invention is to enable shaping to be achieved with great ease to allow pieces with complicated shapes to be made with higher precision. In fact, amorphous precious metals have the particular characteristic of softening while remaining amorphous for a certain period in a given temperature range [Tg–Tx] particular to each alloy (with Tx: crystallisation temperature and Tg: glass transition temperature). It is thus possible to shape them under a relatively low pressure stress and at moderate temperature, thus allowing the use of a simplified process. Moreover, the use of such a material additionally enables fine geometries to be reproduced with high precision since the viscosity of the alloy decreases greatly as a function of the temperature in the temperature range [Tg-Tx] and the alloy thus moulds to all the details of a negative. Negative is understood to mean a mould that has a profile in the cavity that is complementary to that of the desired component. This then makes it possible to form hands in three dimensions, which the techniques of the prior art do not allow or only with difficulty.

Advantageous embodiments of this hand are the subject of the dependent claims.

In a first advantageous embodiment said hand is fixed to its staff by means of a motion work.

In a second advantageous embodiment said hand and said motion work form a single piece.

In a third advantageous embodiment said hand is arranged to be driven by a retrograde movement.

The invention also proposes to provide a chronograph comprising at least one hand according to the present invention.

The invention also proposes to provide a use of the hand according to the present invention for an application, in which at a given moment said hand is subjected to an acceleration of at least 250 000 rad/s$^{-2}$ and preferably an acceleration in the order of 1.10$^{6}$ rad/s$^{-2}$.

The invention also proposes to provide a process for producing the hand according to the present invention, said process comprising the following steps:

a) providing the negative of the hand to be formed;

b) providing a metal alloy that comprises at least one metallic element and is able to solidify at least partially in amorphous phase;

c) shaping said metal alloy in the negative so as to obtain said hand;

d) separating said hand from said negative.

In a first advantageous embodiment step c) comprises the following steps:

- forming a preform with said material, wherein said metal alloy is solidified at least partially in amorphous phase, and placing the preform on the negative;
- heating said preform to a temperature in the range of between the glass transition temperature and the crystallisation temperature of said metal alloy;
- exerting a pressure on the preform in order to fill the negative with said metal alloy;
- cooling said metal alloy such that it retains its at least partially amorphous phase.

In a second advantageous embodiment step c) comprises the following steps:

- heating said metal alloy to above its melting point;
- pouring said metal alloy into said negative;
- cooling the whole such that said metal alloy solidifies at least partially in amorphous phase.

In a third advantageous embodiment the process comprises, before the step of cooling said material, the step consisting of removing the excess material.

In another advantageous embodiment said hand is fixed on its staff by means of a motion work, and said hand and said motion work are a single piece formed during the shaping step c).

In another advantageous embodiment said hand is fixed on its staff by means of a motion work, and said hand is fixed to said motion work during the shaping step c).

In another advantageous embodiment said at least one precious metal element is chosen from the group formed by gold, platinum, palladium, rhenium, ruthenium, rhodium, silver, iridium or osmium.

BRIEF SUMMARY OF THE FIGURES

The aims, advantages and characteristics of the hand according to the present invention will become clearer from the following detailed description of at least one embodiment of the invention given solely as a non-restrictive example illustrated by the attached drawings, wherein.

DETAILED DESCRIPTION

Figure 1:
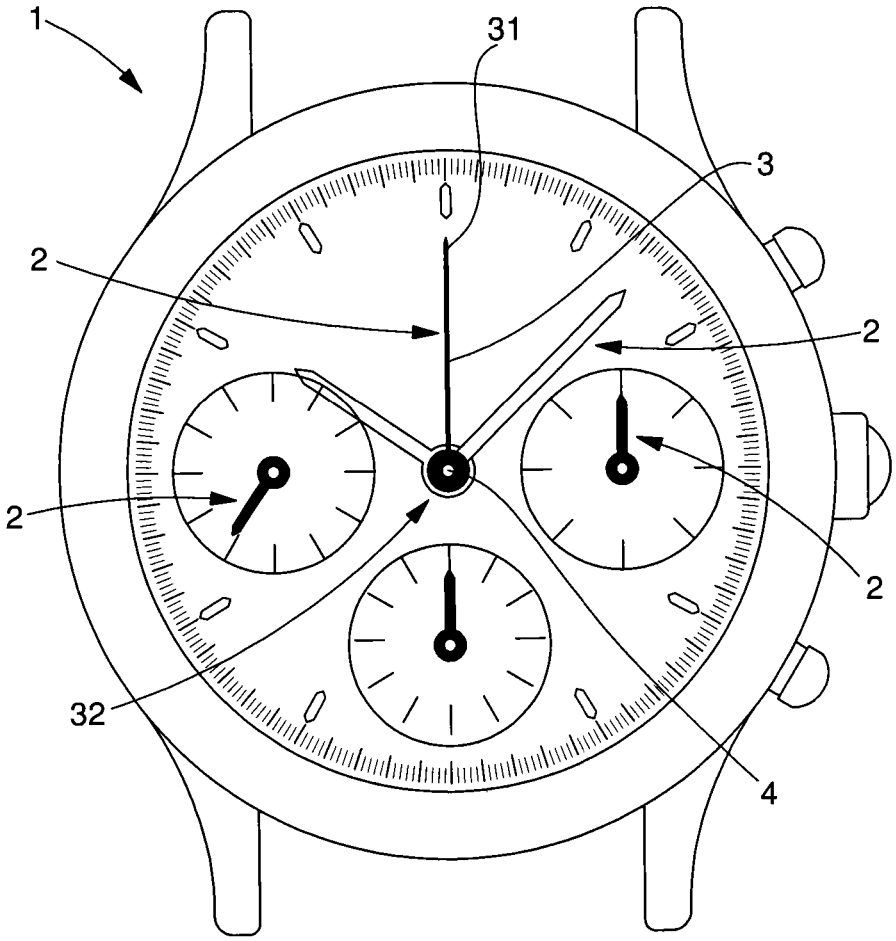
FIG. 1 schematically shows a timepiece with chronograph function.

FIG. 1 shows a timepiece 1 comprising several hands 2 indicating information on the dial of said timepiece. These hands 2 can be hands that indicate the hours, minutes or seconds. They can be driven by continuous or retrograde displacement, wherein said displacement can comprise abrupt accelerations. Abrupt acceleration is understood to mean a sudden acceleration, whether foreseeable or not, that occurs for a limited time and is of very high magnitude, wherein said acceleration follows a displacement of zero, constant or low acceleration. Abrupt accelerations that can be withstood are at minimum 250 000 rad·s$^{-2}$ and preferably 1.10$^{6}$ rad·s$^{-2}$. These hands 2 can also be hands of a chronograph or calendar or other. Such a hand 2 shown in FIG. 2 consists of a bar 3 with a length that is much larger than the width of this bar 3, and this width is itself much larger than the thickness. A first end 31 of the bar serves to point at a piece of information. This first end 31 is preferably the finest end. An opening 4 is provided to allow the hand to be pressed onto its staff 10. This opening 4 is arranged close to the second end 32 of the bar forming the hand 2. This second end 32 can be arranged in order to serve as an unbalance to ensure a good balance of the hand 2 during its displacement. It is also conceivable that the second end 32 is arranged to be circular and contain the opening 4 allowing it to be pressed onto its staff 10, as can be seen in FIG. 1.

Figure 2:
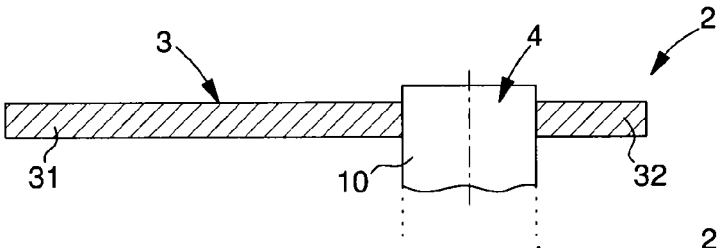
FIGS. 2 to 4 schematically show sectional views of timepiece hands.
Figure 3:
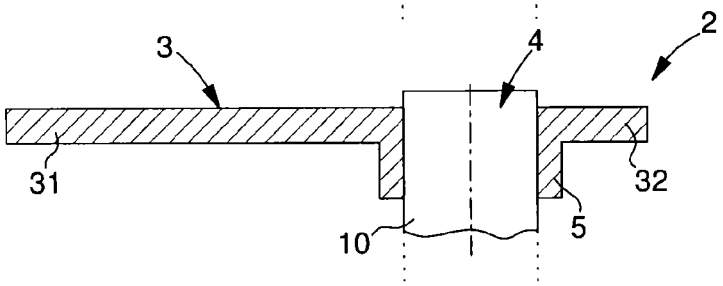
Figure 4:
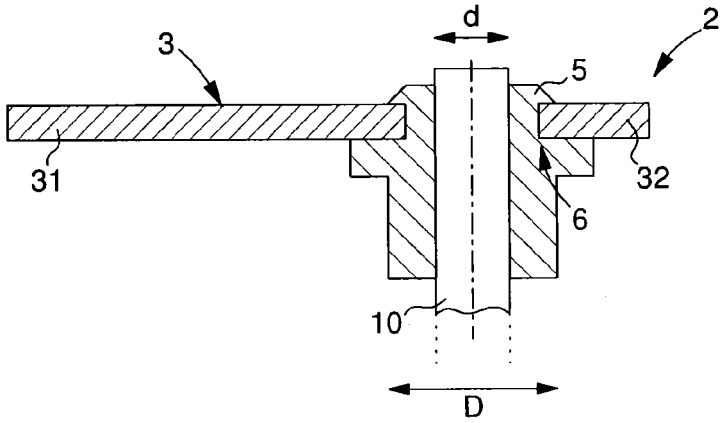

The hand 2 is mounted on a staff 10 by being pressed directly onto said staff 10, as shown in FIG. 2, or being connected to a motion work 5 that is itself pressed onto the staff 10, as shown in FIG. 4. It is also possible that the motion work 5 consists directly of a single piece with the hand 2, as shown in FIG. 3.

Advantageously, at least one of the hands 2 is made from an at least partially amorphous material containing at least one metallic element. This metallic element can be precious such as gold, platinum, palladium, rhenium, ruthenium, rhodium, silver, iridium or osmium. An at least partially amorphous metal alloy is understood to mean that the material is capable of solidifying at least partially in amorphous form, i.e. it is able to lose all its crystalline structure at least locally.

Figure 5:
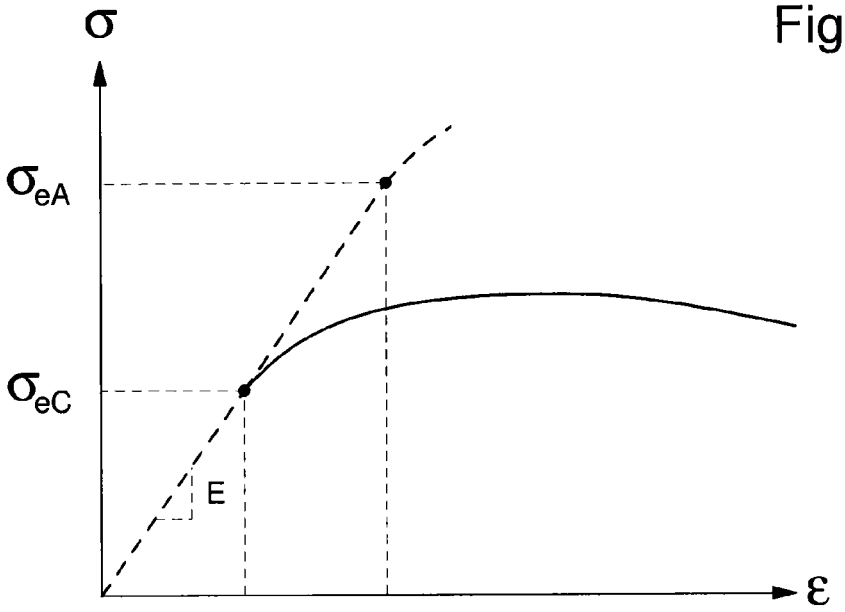
FIG. 5 shows deformation curves for a crystalline material and for an amorphous material.

In fact, the advantage of these amorphous metal alloys results from the fact that during their formation the atoms forming these amorphous materials are not arranged according to a particular structure as is the case with crystalline materials. Therefore, even if the Young's modulus E of a crystalline metal and that of an amorphous metal are substantially identical, the elastic limit $\sigma_e$ is different. An amorphous metal is thus distinguished by a higher elastic limit $\sigma_{eA}$ than that $\sigma_{eC}$ of the crystalline metal by a factor essentially equal to two, as shown in FIG. 5. This figure shows the curve of the stress a as a function of the deformation c for an amorphous metal (dotted line) and for a crystalline metal (solid line). Moreover, the maximum energy that can be stored elastically is calculated as being the ratio between the square of the elastic limit $\sigma_e$ and the Young's modulus E. With a higher elastic limit by a factor substantially equal to two, the energy that the amorphous metal can store elastically is therefore higher than a factor substantially equal to four. This means the amorphous metals can be subjected to a higher stress before reaching the elastic limit $\sigma_e$.

A hand 2 made of amorphous metal can firstly improve the reliability thereof in relation to its equivalent made of crystalline metal. In fact, the stress applied to the hand 2 is linked to the moment of inertia of the hand 2, which is dependent on the mass and the length. Hence, the longer the hand or the higher the mass at the end of the hand 2 and the higher the moment of inertia of the hand 2 will be. The kinetic energy accumulated during the displacement of the hand 2 following a return to zero or a shock is dependent on the moment of inertia. This kinetic energy determines the stress applied to the hand 2 during the return to zero movement or during the shock. A high kinetic energy results in a high stress and therefore a significant risk of deformation.

Since the elastic limit $\sigma_e$ is higher for an amorphous metal than for a crystalline metal, the stress to be applied to obtain plastic deformation is higher. Thus, with equivalent kinetic energy, a hand 2 made of amorphous metal will be less at risk of plastically deforming than a hand 2 made of crystalline metal.

A material can also be characterised by its specific strength, which is the ratio of the elastic limit to the density. An amorphous metal has a higher specific strength than a crystalline metal, since, on the one hand, with the same type of alloy, the amorphous metal has an elastic limit that is about twice as high and, on the other hand, with a given composition, the amorphous structure has a density that is about 10% lower than that of the crystalline structure. The result of this is that a hand made of an amorphous metal alloy or amorphous metal will be lighter than a hand of the same dimensions made from a metal alloy of the same composition but with a crystalline structure. The moment of inertia will therefore be lower for the hand made of amorphous metal, since the moment of inertia is linked to mass. The kinetic energy, and therefore the stress applied to the hand made of amorphous metal, will be lower so that the hand will be able to withstand a higher stress before plastically deforming.

This advantage of density combined with the ability of amorphous metals to withstand a higher stress before plastically deforming allows the use of amorphous precious metal alloys. In fact, the elastic limit of an amorphous precious metal alloy is higher by a factor approximately equal to two in relation to its crystalline equivalent. Said amorphous precious metal alloy can therefore withstand a higher stress than its crystalline equivalent before plastically deforming. The stress is linked to the kinetic energy, which is itself linked to the moment of inertia that is dependent on the mass and length. Consequently, as the amorphous metal alloys, whether of precious metal or not, have a lower density than their crystalline equivalents, their displacements exhibit a lower kinetic energy and therefore a lower stress. Thus, a hand made from an amorphous precious metal alloy of the same dimensions as a hand made of a crystalline precious metal alloy will have a lower mass and its displacement will generate a lower stress. Since the stress is lower and the maximum stress withstood is higher, the use of amorphous precious metal alloys to form hands that must withstand significant and abrupt accelerations is possible contrary to the preconceptions of a person skilled in the art.

Secondly, the characteristics of the amorphous metal make more varied forms of hands 2 conceivable. In fact, the moment of inertia is used to determine the kinetic energy of the hand and the stress that it will be subjected to during its return to zero. This moment of inertia is dependent on the mass and length of the hand 2. These parameters are therefore calculated to limit the risk of plastic deformation of the hand 2.

Since the amorphous metal can withstand a higher stress, i.e. a higher kinetic energy and therefore a higher moment of inertia, the mass and length of the hand 2 can be increased without thus risking plastic deformation. More specifically, the mass at the first end of the hand 2 can be increased allowing possibilities of larger forms of hands 2. It is thus possible to provide that this first end comprises a zone with larger dimensions, for example, that allow a luminescent material to be used, or that the sweep hand of the chronograph takes the form of a Breguet hand 2. It is also possible that the mass at the second end 32 that can serve as unbalance is increased.

While the characteristics of the amorphous metal allow the dimensions of the hands 2 to be increased, they also allow hands 2 with smaller dimensions to be formed. In fact, with equivalent stress the hand 2 could be smaller in length and/or lower in mass without plastically deforming, this resulting from a higher elastic limit. This decrease in dimensions can also be applied to the unbalance of the hand 2 that serves to balance said hand 2.

Therefore, the amorphous metal, whether precious metal or not, has the double advantage of allowing the size of the hands 2 to be increased or decreased without increasing the risk of plastic deformation. The reduction in size and/or mass of the hand can be achieved by arranging recesses 11, which can be passages or not, on the hands 2, as evident from FIG. 15. These recesses 11 allow the mass of the hands 2 to be reduced by the removal of material and therefore allow the moment of inertia to be reduced, while providing an interesting visual effect.

Several methods are conceivable for producing a hand 2 from amorphous metal.

Firstly, it is possible to use the traditional methods of stamping or cutting. The amorphous metal is therefore firstly arranged in the form of fine sheets. These fine sheets are then stamped by pressing or cut out by water jet or laser.

However, it is possible to use the properties of the amorphous precious metal for shaping. In fact, amorphous metal allows shaping to be achieved with great ease to enable pieces with complicated shapes to be made with higher precision. This is due to the particular characteristics of the amorphous metal, which can soften while remaining amorphous over a certain period in a given temperature range [Tg-Tx] specific to each alloy (for example, for an alloy $Zr_{41.24}Ti_{13.75}Cu_{12.5}Ni_{10}Be_{22.5}$, Tg=350° C. and Tx=460° C.). It is thus possible to shape them with a relatively low stress and at a moderate temperature, thus allowing the use of a simplified process such as hot forming. The use of such a material additionally enables fine geometries to be reproduced with high precision since the viscosity of the alloy decreases significantly as a function of the temperature in the temperature range [Tg-Tx] and the alloy thus moulds to all the details of the negative. For example, in the case of a platinum-based material shaping occurs at around 300° C. with a viscosity reaching $10^3$ Pa·s with a force of 1 MPa instead of a viscosity of $10^{12}$ Pa·s at the temperature Tg. The use of dies has the advantage of creating high-precision pieces in three dimensions, which cutting or stamping does not permit.

Figure 6:
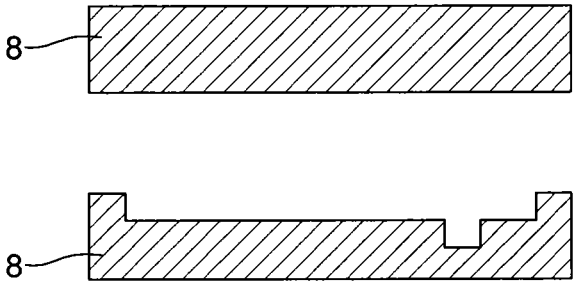
FIGS. 6 to 9 schematically show the process according to the invention.
Figure 7:
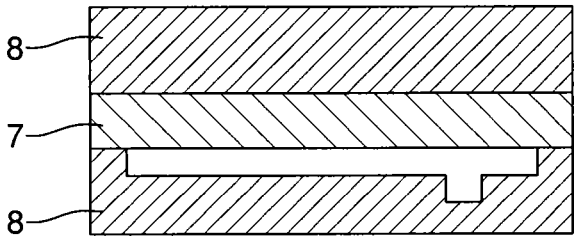
Figure 8:
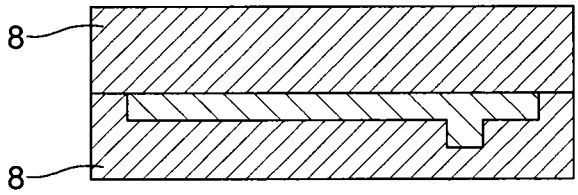
Figure 9:
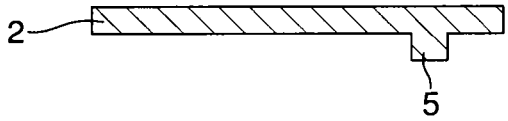
Figure 10:
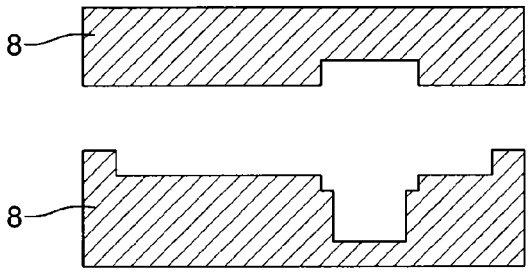
FIGS. 10 to 14 schematically show a variant of the process according to the present invention.

A process used is the hot forming of an amorphous preform. This preform 7 is obtained by melting the metallic elements intended to form the amorphous alloy in an oven. This melting is conducted in a controlled atmosphere so that any contamination of the alloy with oxygen will be as low as possible. Once these elements are melted, they are cast in the form of a semi-finished product, such as e.g. a bar with dimensions close to those of a hand, then cooled rapidly in order to retain the at least partially amorphous state. Once the preform 7 is made, the hot forming is conducted in order to obtain a final piece. This hot forming is conducted by pressing in a temperature range of between its glass transition temperature Tg and its crystallisation temperature Tx for a determined period to retain a completely or partially amorphous structure. This is done in order to retain the elastic properties characteristic of amorphous precious metals. The different steps of the final shaping of the hand 2 are therefore:

a) heating dies 8 having the negative form of the hand 2 to a chosen temperature, as shown in FIG. 6, b) inserting the amorphous metal preform 7 between the hot dies, as shown in FIG. 7, c) applying a closing force to the dies 8 in order to replicate the geometry thereof on the amorphous precious metal preform 7, as shown in FIG. 8, d) waiting for a chosen maximum period, e) opening the dies 8, f) rapidly cooling the hand 2 to below Tg so that the material retains its at least partially amorphous state, and g) removing the hand 2 from the dies 8, as shown in FIG. 9.

Figure 15:
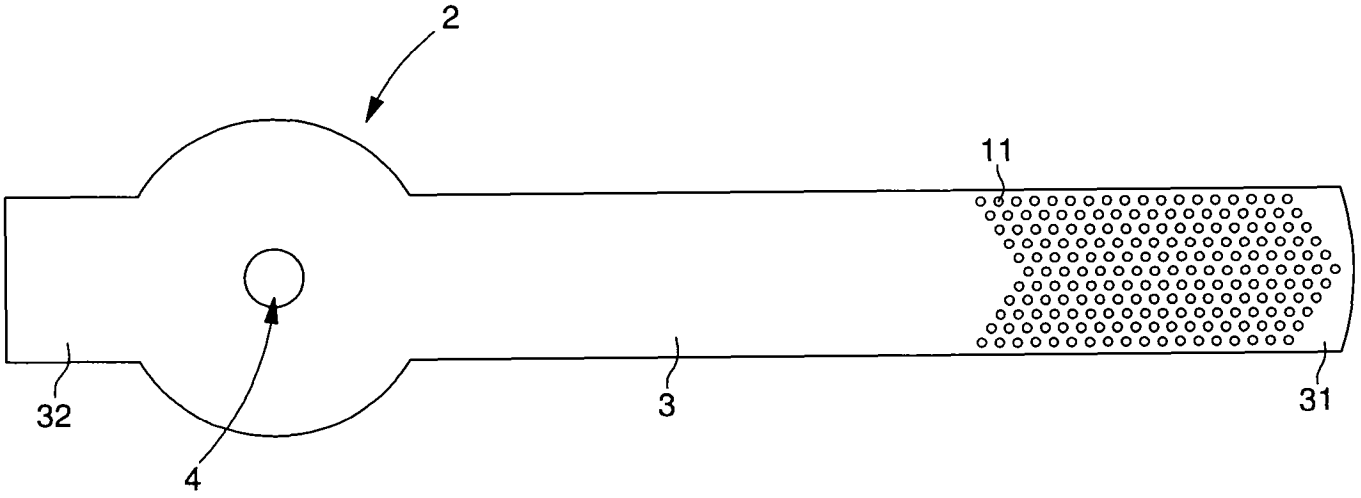
FIG. 15 is a plan view onto a variant of the hand according to the present invention.

Hot forming allows the formation of said hand 2 to be simplified, in particular for the formation of the recesses 11 of the hand shown in FIG. 15.

Moreover, it is possible to form the hand 2 directly with its motion work 5 using the hot forming technique, as evident from FIGS. 6 to 9. This therefore means that the motion work 5 and the hand 2 are only made from the very same piece as evident in FIG. 3. The dies 8 forming the mould are therefore arranged to shape the negative of the hand 2 and its integrated motion work 5. Steps a) to g) are thus performed to form said hand 2. Because of this arrangement of the hand 2 and its motion work 5 in a single piece there is no problem of fixture between said hand 2 and its motion work 5.

Figure 11:
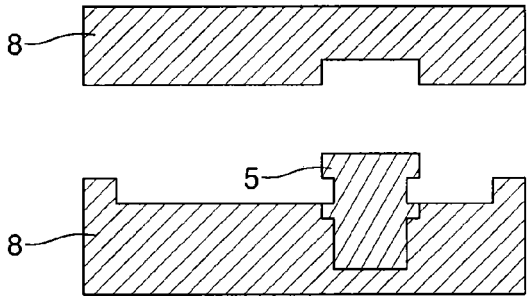
Figure 12:
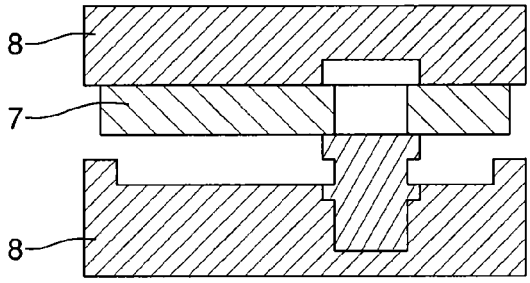
Figure 13:
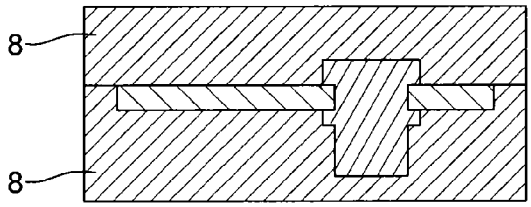
Figure 14:
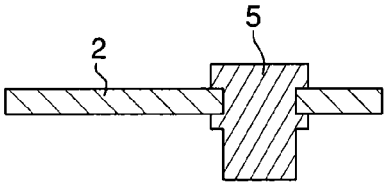

It is provided in a variant to form a hand 2 directly fixed to the motion work 5. The motion work 5 shown in FIG. 4 consists of a cylindrical piece having an inside diameter d that is equal to the diameter of the shaft 10, onto which the motion work 5 is pressed. The motion work 5 has an outside diameter D that is larger than the inside diameter d and the outside diameter D can be non-uniform over the whole of the motion work 5. The profile of this motion work 5 has an annular recess 6, in which the hand 2 is positioned. This recess that has a diameter between the inside and outside diameters enables the hand 2 to be held axially. The motion work 5 is positioned between the dies 8, in which the hand 2 will be formed, as shown in FIG. 11. Steps a) to g) described above are then performed and are shown in FIGS. 12, 13 and 14. As a result, the hand 2 is moulded directly onto the motion work 5 and is thus fixed directly to the motion work 5. It can be provided that the wall of the annular recess has raised sections or other means to improve the hold of the hand 2 in the motion work 5 and in particular the angular hold.

It will be understood that various modifications and/or improvements and/or combinations obvious for the person skilled in the art can be applied to the different embodiments of the invention discussed above without departing from the framework of the invention defined by the attached claims.

It will, of course, be understood that the hand 2 or the piece forming the motion work 5 and the hand 2 can be formed by casting or by injection. This process consists of casting the alloy obtained by melting the metallic elements in a mould having the shape of the final piece. Once the mould has been filled, it is rapidly cooled to a temperature lower than $T_g$ to prevent crystallisation of the alloy and thus obtain a hand 2 made of amorphous or partially amorphous precious metal.

The invention claimed is:

1. A method of using a timepiece hand mounted around a shaft so as to indicate an item of information, comprising:

subjecting the hand at a given moment to an acceleration of at least 250,000 rad/s$^2$, wherein the hand is able to withstand the acceleration without deforming, wherein said hand is made from a completely amorphous metal alloy comprising at least one metallic element.

2. The method according to claim 1, wherein at a given moment said hand is subjected to an acceleration on an order of $1.10^6$ rad/s$^2$.

3. The method according to claim 1, wherein said hand is fixed to the shaft by a motion work.

4. The method according to claim 3, wherein said hand and said motion work form a single piece.

5. The method according to claim 1, further comprising driving the hand by a retrograde movement.

6. The method according to claim 1, wherein said hand is made in a completely amorphous metal alloy.

7. The method according to claim 1, wherein the metallic element is chosen from the group formed by gold, platinum, palladium, rhenium, ruthenium, rhodium, silver, iridium or osmium.

* * * * *